US005727334A

United States Patent [19]

Cougar

[11] Patent Number: 5,727,334

[45] Date of Patent: Mar. 17, 1998

[54] SAFETY SHOE WITH HIGH-TRACTION REPLACEABLE SOLE

[76] Inventor: Daniel Duane Cougar, 13611 Van Dorn Rd., Manassas, Va. 22111

[21] Appl. No.: 644,200

[22] Filed: May 10, 1996

[51] Int. Cl.[6] ..... A43C 13/00

[52] U.S. Cl. ..... 36/15; 36/7.5; 36/113

[58] Field of Search ..... 36/15, 7.5, 113, 36/101, 100

[56] References Cited

U.S. PATENT DOCUMENTS

| | | | |
|---|---|---|---|
| 2,628,437 | 2/1953 | Forsythe . | |
| 2,706,350 | 4/1955 | Kenny . | |
| 3,538,628 | 11/1970 | Einstein, Jr. | 36/15 |
| 3,721,024 | 3/1973 | Imnerbickler . | |
| 4,012,855 | 3/1977 | Gardner | 36/59 R X |
| 4,228,600 | 10/1980 | Krug et al. | 36/30 R X |
| 4,279,083 | 7/1981 | Dilg | 36/101 |
| 4,413,429 | 11/1983 | Power | 36/30 R |
| 4,598,485 | 7/1986 | Joe et al. . | |
| 4,702,021 | 10/1987 | Cameron . | |
| 4,716,663 | 1/1988 | Steinhauser . | |
| 4,779,360 | 10/1988 | Bible . | |
| 4,897,935 | 2/1990 | Fel . | |
| 4,924,608 | 5/1990 | Mogonye . | |
| 4,926,568 | 5/1990 | Coffman | 36/15 |
| 5,228,215 | 7/1993 | Bayer . | |
| 5,259,125 | 11/1993 | Gromes . | |

FOREIGN PATENT DOCUMENTS

| | | | |
|---|---|---|---|
| 2633161 | 12/1989 | France | 36/101 |
| 3536959 | 4/1987 | Germany | 36/101 |

*Primary Examiner*—Ted Kavanaugh

*Attorney, Agent, or Firm*—Kerkam, Stowell, Kondracki & Clarke, P.C.; John C. Kerins

[57] ABSTRACT

A shoe having a replaceable sole pad for use by roofers is provided wherein the shoe has a thin lower flexible portion with a sheet or layer of hook fasteners of the hook-and-loop type fastener system disposed on a bottom surface thereof, and wherein a replaceable sole pad is provided having a sheet or layer of the corresponding loop elements provided on an upper surface thereof. The sole pad is constructed of a high density, closed-cell foam that provides greatly improved traction on roofing surfaces, thereby improving worker safety and productivity or efficiency, and provides adequate durability to make the shoe with the replaceable soles cost justifiable, when factoring in the improved productivity. The sole pad is installed and removed from the shoe in the conventional manner in which two object are fastened and unfastened by the use of hook-and-loop fasteners.

18 Claims, 1 Drawing Sheet

SAFETY SHOE WITH HIGH-TRACTION REPLACEABLE SOLE

BACKGROUND OF THE INVENTION

1. Field of the Invention

The present invention is directed to a shoe having a high traction, replaceable, sole pad. The shoe is especially well suited for use by roofers and others working on steeply inclined surfaces.

2. Description of Related Art

Many devices have been developed over the years to improve the stability of roofers working on the inclined pitches commonly encountered. This is a problem that has worsened in recent years, particularly in the residential building market, as many newer homes are being designed with steeper roof pitches than had previously been used in residential construction.

The different types of traction-improving devices developed for use by roofers are numerous. Many years ago, steel or metal shoe attachments were prevalent in the patented art, which attachments generally had spikes or pointed spurs that would extend downwardly from the sole once the attachment was fastened in place. Some of the devices of this type were constructed such that the shoe would be maintained in a substantially horizontal position, and the device would have angled plates to engage the pitched roof surface and to support the shoe in a horizontal position.

Other patents evidence attempts to provide a sole or a shoe attachment that provides improved traction over a normal shoe sole. U.S. Pat. No. 2,628,437, to Forsythe, discloses an anti-slip shoe attachment which has a sole formed from a flexible sheet of coarse abrasive material. U.S. Pat. No. 5,259,125, to Gromes, discloses an attachment for the front part of a shoe having a sole made of indoor-outdoor carpet of a medium weave, that is said to provide improved traction for the wearer. That patent also discusses other various designs and devices previously proposed for use in aiding roofers to maintain better traction.

As further noted in the Gromes patent, asphalt roof shingles have been used extensively in roof constructions for a good number of years. The roof shingles have various grades of stone gravel embedded in a flexible, petroleum-based, sheet material. Care must be taken by the roofer not to damage the shingles, either by tearing or gouging the shingle, or by causing a large amount of the embedded gravel to be scraped off, during installation and thereafter in completing construction of a house or other building. Generally speaking, a hard or relatively rigid material that might otherwise provide acceptable anti-slip properties would not be suitable for use by roofers because such surfaces would be too prone to damaging the shingles.

Other anti-slip soles and shoe attachments have been developed for specific applications outside the roofing business. U.S. Pat. No. 4,924,608, to Mogoyne, discloses a replaceable anti-slip sole that is constructed of a non-woven synthetic, fibrous material. The shoe is intended to be used by maintenance persons such as floor cleaners, to provide traction on wet, slippery floors. Indeed, the anti-slip material is disclosed as preferably being the same material as is used on the cleaning machines themselves. While soles made of this material are disclosed as being durable, the surface on which these soles are used is not abrasive, but exactly the opposite, i.e., very slippery and substantially horizontal. The professed durability of the anti-slip material appears to be principally directed to the material's resistance to attack by chemicals and cleaning compounds, and not a physical durability.

It is believed that such soles would not be suitable for use on a roofer's shoe, primarily due to the lack of durability if used on an abrasive working surface. Further, as noted in the Gromes patent, the problem facing roofers is not that the surface is inherently slippery, but rather the surface is presented to the roofer or other worker at steep inclines. Materials that provide increased traction on wet floors may not perform adequately on an abrasive, but angled, surface.

U.S. Pat. No. 4,897,935, discloses a shoe attachment or an overshoe, principally for use on sloping and/or slippery ground. The non-slip surface is disclosed as being an open-celled foam of low density, defined in that patent as between 30–40 kg/m$^3$. The non-slip layer is disclosed as being replaceable, and is secured to an intermediary foam layer of slightly higher density, by an adhesive. The open-cell, low density non-slip surface of this device would not be suitable for use on a roofer's shoe, from the standpoint of the lack of durability, and also because it is believed that the layer would not provide sufficient traction, and instead would tear or shred when placed in contact with asphalt shingles, once higher shear forces are applied.

The surfaces that a roofer encounters, such as plywood sheathing, a tar paper interlayer, and the asphalt shingles, are not themselves inherently slippery. It is the slope at which these surfaces are presented, and the fact that the roof is at a considerable distance above ground, that make improved traction on angled, ofttimes abrasive, surfaces so important for the shoe sole. The sole must also be reasonably resistant to wear when used on these sloping abrasive surfaces. Despite the prior attempts to fashion a shoe or shoe attachment suitable for use by roofers, a strong need persists in this field for a shoe that provides a combination of high traction and durability at a reasonable cost, thus making it economically feasible for roofers to buy and wear the shoes, or for a company to outfit its workers with such shoes.

One factor that appears to have been largely overlooked in the design of shoes for roofers is that a somewhat greater expense for the shoes over the long-term can be justified if the shoe provides such good traction that the efficiency of the roofer or other worker is improved due to the ability to more quickly and ably move about on the pitched surface. The above-noted Gromes patent and other patents directed to attachments for roofers' shoes tacitly acknowledge that additional expense may be justified in attempting to improve safety, but do not directly address worker efficiency. These patents approach the problem by providing devices that are not a part of the shoe, but are instead attachments to be worn over the shoe while the person is working on the roof. Thus, while better traction might be provided, the attachments add weight to the shoe, generally decrease the flexibility of the footwear, and may also prove to be unwieldy when the worker attempts to move around on the roof.

As noted previously, the principal problem with maintaining traction on a shingled surface is not that the shingles are inherently slippery, but that they are presented on a slope, and, particularly in new residential construction, the roofs have, in recent years, been designed to have even steeper pitches. Various materials were assessed in developing the shoe design and sole pads of the present invention, including the principal types of shoes currently worn by roofers.

Conventional athletic shoes (or tennis shoes) and work boots are the prevalent types of footwear worn by roofers today. Those generally have high density, solid, hard rubber soles, which provide a fairly durable shoe, in terms of wear and sole life, when used on the types of surfaces encountered by roofers. However, such soles are problematical in terms of the traction they provide. The relatively hard, solid soles can tend to lose traction as the wearer moves around on the roof, as the material is not resilient enough to "grab" or "bite into" the shingles and other roofing material. Where such a material does "grab" the shingle, it is generally at the expense of gouging the shingle, i.e., exerting force that has the result of dislodging the stone gravel making up the upper surface of the shingle. It is not uncommon that courses of shingles have to be replaced because they have been gouged. Other hard, solid sole materials, such as shoe leather, would have substantially the same disadvantages.

Open-celled foams may have reasonably good anti-slip properties, from the standpoint of being resilient and thus being able to grab or grip the roofing surfaces. Low density, open-cell foams, of the type disclosed for use as the anti-slip surface for the shoe attachments in the above-noted U.S. Pat. No. 4,897,935, to Fel, would not, however, be sufficiently durable to evaluate their anti-slip properties, as the low density foams would be quickly shredded and worn away by the asphalt shingles. Higher density open-cell foams would be only slightly more durable, but the open-cell nature of the material causes even the higher density material to wear rapidly, as well. Such materials are not sufficiently durable, even if made to be replaceable, to be suitable for use by roofers. The soles would have to be replaced possibly up to several times a day, thereby severely adversely impacting the worker's efficiency, and possibly making the shoe and sole itself cost prohibitive.

SUMMARY OF THE INVENTION

In view of the above drawbacks or deficiencies in prior devices, it is a principal object of the present invention to provide a shoe and an anti-slip sole member or sole pad for a shoe that will provide improved traction and anti-slip properties when worn on sloping surfaces, while at the same time will provide sufficient durability when used on the sloping, abrasive surfaces of a roof, such that the shoe will be economically feasible to use on a regular basis.

It is a further principal object of the invention to provide a shoe and an anti-slip sole member for a shoe, wherein the sole is replaceable, such that, when the sole does wear out, a new sole can be placed on the shoe, thus providing a shoe having extremely good traction or anti-slip properties, and overall long life at a reasonable cost.

It is a further object of the invention to provide a replaceable sole made of a dense closed-cell foam material which provides greatly traction over conventional shoe soles and which,although not as durable overall as some conventional shoe soles, is sufficiently durable that the cost of the replacement soles is more than made up in terms of increased efficiency and safety.

The above and other objects of the present invention are achieved in the present invention by providing a shoe and a replaceable sole member or sole pad for the shoe, that will provide more sure footing on sloping roofing surfaces, and that will thereby increase worker efficiency. The replaceable sole pad is made of a high density foam material that is closed celled in nature. It has been discovered in connection with the development of this invention that a high density, closed-cell foam provides optimal traction on various roofing surfaces. The traction provided by this material is vastly improved over conventional athletic or tennis shoe soles and conventional work boots, and the material performed better in terms of traction and durability than other materials evaluated.

BRIEF DESCRIPTION OF THE DRAWINGS

These and other features of the present invention and the attendant advantages will be readily apparent to those having ordinary skill in the art and the invention will be more easily understood from the following detailed description of the preferred embodiment taken in conjunction with the accompanying drawings wherein like reference characters represent like parts throughout the several views.

DETAILED DESCRIPTION OF THE PREFERRED EMBODIMENT

Figure 1:
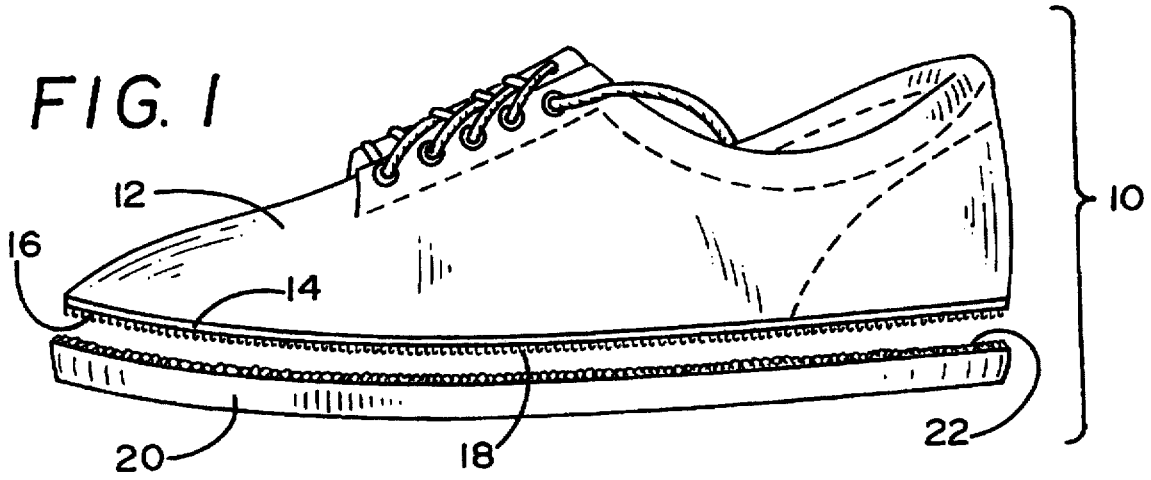
FIG. 1 is a side elevation view of a shoe having a replaceable sole pad adapted to be removably secured thereon in accordance with a preferred embodiment of the present invention.

Referring to the drawings, FIG. 1 shows a preferred embodiment of the safety shoe 10 of the present invention. The shoe has an upper portion 12 secured to a flexible lower portion 14 in making up the part of the shoe surrounding the wearer's foot. The shoe 10 is preferably constructed in the same manner as is a conventional athletic shoe, with the exception that it is preferred that the flexible lower portion 14 be of a thickness less than the thickness of the soles commonly provided on conventional athletic shoes. It is preferred that the lower flexible portion 14 be made of rubber of a type similar to that used on conventional athletic shoes, but in a thickness of around ⅛ inch, which is approximately the thickness of the sole used on wrestling shoes, a specialty type of athletic shoe. The sole thicknesses commonly found on conventional athletic shoes such as running shoes, cross-training shoes, or tennis shoes are generally much thicker, in the range of around ½ inch to ¾ inch.

The use of a thin lower flexible portion 14 provides several important advantages. The thinner material provides increased flexibility of the shoe, which, although less important on flat surfaces, will allow, on sloping surfaces, the feet of the roofers or other workers wearing the shoe 10 to more readily engage the sloping surface, and to make the worker more agile in walking on the sloping surface. In addition, when the replaceable sole pad 20 is attached or fastened to the bottom of the shoe, the combined thickness of the lower flexible portion 14 and the sole pad 20 more closely approximates the normal thickness of an athletic shoe sole, rather than increasing the thickness of the overall shoe sole by adding a sole pad to a shoe sole having a conventional thickness. This is of considerable significance in light of the intended use of the shoe by roofers, in that the worker needs to remain stable. A thicker shoe sole, such as would result in the Mogoyne patent or when using an attachment like that in Gromes, can increase the risk of the worker having his foot roll over the outside edge of the shoe and twisting his ankle, and potentially causing a fall.

The lower surface 16 of the lower flexible portion is provided with a fastening element, which, in the preferred embodiment is a sheet or layer 18 containing the hook elements of a hook-and-loop type fastener such as VELCRO®. The sheet 18 is substantially permanently bonded to the lower surface of the lower flexible portion 14 of the shoe by a suitable bonding medium, such as an adhesive. In addition to, or possibly instead of, using the adhesive bonding, the sheet 18 may be stitched (see FIG. 3) with a durable stitching material 30 to the lower flexible portion, particularly, for example, near the outer periphery of the lower flexible portion. This may be advantageous where it is anticipated that, due to the rugged environment in which these shoes will be used, the adhesive at the exposed peripheral edges of the sheet 18 of hook material might be attacked and lose its adhesive properties.

Figure 2:
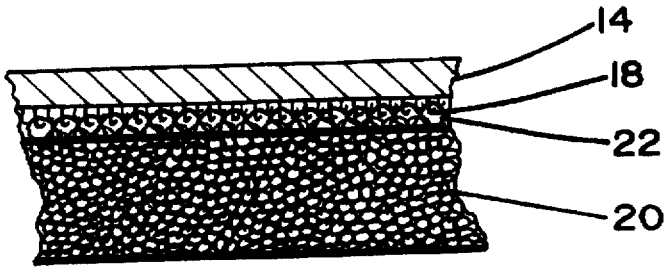
FIG. 2 is a side elevation view of a portion of the replaceable sole pad and the fastener element disposed thereon, in accordance with a preferred embodiment of the present invention.
Figure 3:
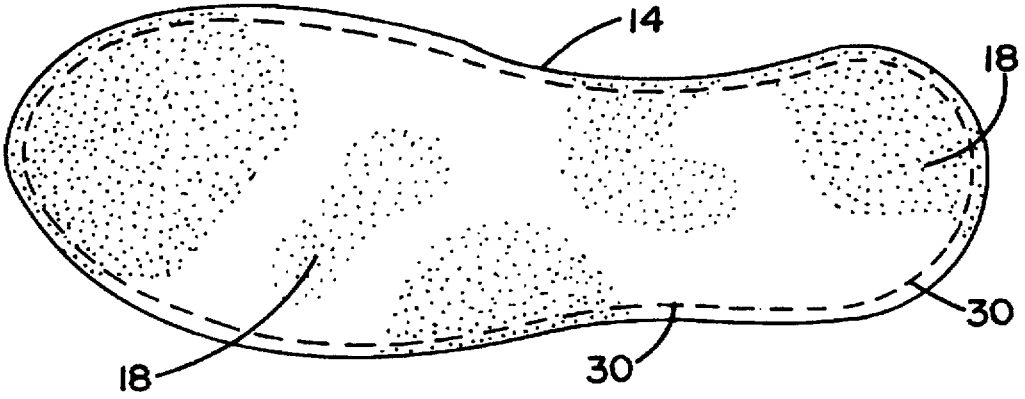
FIG. 3 is a bottom plan view of the safety shoe according to a preferred embodiment of the present invention.

It is noted that, while FIG. 3 shows the fastening element 18 attached to the lower flexible portion of the shoe as being a unitary sheet of the hook-type material numerous variations as to the placement of the material are envisioned. This would include the use of strips or tapes of the hook-type material extending in the heel-to-toe direction, as is shown in FIG. 2 of U.S. Pat. No. 4,924,608, which is incorporated herein by reference. Further variations would include providing the sheet 18 in two separate sections, leaving the arch area of the shoe 10 exposed, and using strips or tapes extending at a different orientation, such as transverse to or at an oblique angle to the heel-and-toe direction of the shoe.

As also shown substantially schematically in FIG. 3, the sheet 18 of hook-type fasteners may be secured to the lower flexible portion 14 of the shoe by stitching 19, which may prove to be advantageous in maintaining the peripheral edges of sheet 18, which will be exposed to the roofing surfaces, secured to the shoe.

Concentrating now on FIGS. 1 and 2, the inventive replaceable sole pad 20 of the safety shoe of the present invention will be described. Sole pad 20 is preferably provided in a plan shape (see FIG. 3) substantially identical to the shape of the lower flexible portion 14 of the shoe, such that it will cover the entire lower flexible portion, and the sole pad and the lower flexible portion, once fastened, will together function in a manner similar to a sole of a conventional shoe. FIG. 1 shows the sole pad 20 separated from lower flexible portion 14, and in use, these two elements are mated and fastened by applying pressure to have the hooks and loops engage each other.

Sole pad 20 is preferably constructed of a closed-cell foam material, having a density in the range of about 1.5 to about 30 pounds per cubic foot (lb/ft.$^3$)

An even more preferred range of densities for the closed-cell foam is between about 4.5 lb/ft.$^3$ and 16 lb/ft.$^3$, as products in that range have, to date, proven to provide a very desirable combination of high traction, suitably long wear, and proper feel as a sole pad for a shoe.

Several types of foam material should be suitable for use, provided that they are closed-cell in nature and have a high density for closed-cell foams. Neoprene, Vinyl Nitrile, Styrene-Butadiene Rubber (SBR), Polyethylene (PE), ethyl vinyl acetate (EVA), ethylene propylene terpolymer (EPT), EPT/PE/ButylRubber, Neoprene/EPT/SBR, epichlorohydrin (ECH), an nitrile (NBR) are among the types of polymers that would provide suitable closed-cell foam layers 20 for use a sole pad 20 in the present invention. Neoprene and vinyl/nitrile appear to be the most promising polymers among the above polymers at the present time.

Certain closed cell foams having the preferred characteristics noted above are commercially available through the Rubatex® company. Among the closed-cell foam products currently available through Rubatex, the products sold under the designations R-411-N (10–16 lb/ft.$^3$), R-1800-FS (4.5–8.5 lb/ft.$^3$), G-207-N (15–30 lb/ft.$^3$) and G-231-N (10–20 lb/ft.$^3$), are believed to be particularly suitable for use as sole pads 20 in the present invention.

The high density and closed cell characteristics of the foam material are believed to be critical features in terms of providing the necessary anti-slip characteristics for the sole pad, as well as providing a desirable degree of durability as used in the roofing applications. FIG. 2 is intended to show the closed-cell, dense nature of the sole pad 20 material.

As noted in the background section of this application, various harder (less resilient) and softer (more resilient) materials proved to have drawbacks that rendered them unsuitable for providing an improved safety shoe for roofers and other persons working on roofs and other sloping surfaces. The closed cell foam employed as the sole pad 20 in the present invention provides greatly improved anti-slip characteristics, and the resiliency and softness (relative to the hardness of the gravel particles on the shingles) of the material effectively reduce or eliminate gouging of the asphalt shingles. The sole pad is able to conform to the rough, irregular surface by deforming around the gravel particles, instead of simply pushing against the particles, and dislodging them in the process, which is how traction is achieved by the rubber soles of athletic shoes and work boots.

Closed-cell foam material, in general, demonstrated a greater resistance to wear when used on shingles and roofing surfaces, as compared to open-cell foams that were evaluated in developing the instant invention. The use of a high-density closed-cell foam for the removable sole pad 20 provides the advantages of increased wear life, and a feel that is, to a certain extent, similar to the feel of conventional athletic shoes. The high-density closed-cell foam sole pads will also stand up reasonably well to other abrasive surfaces that a worker will normally encounter in a typical day, such as concrete sidewalks, and concrete or asphalt driveways.

The sole pad 20 preferably has a sheet or layer 22 of the loop elements of a hook-and-loop type fastener of the same plan shape as the sole pad 20, and the sheet is substantially permanently secured to the sole pad 20 by adhesive or other suitable means. One expected preferred manner of effecting a permanent securement of sheet 22 to sole pad 20 is to laminate sheet 22 onto the foam layer 20 as the foam layer is being produced.

The preferred thickness of the sole pad 20 is in the range of ¼ inch to ¾ inch. If the sole pad were thinner than ¼ inch, the sole pad might not provide sufficient service life when used by roofers installing asphalt shingle roofs on a daily basis, as the foam will gradually be worn away by the shingles. Sole pads thicker than ¾ inch would provide even greater service life, but at the expense of making the overall sole of the assembled shoe, i.e., the lower flexible portion 14 of the shoe and the sole pad 20, substantially thicker than shoes commonly worn today. This could result in the aforenoted diminished stability of the worker walking on the roof, and will also, to some extent, reduce the desired flexibility of the sole.

Based on experimentation conducted in developing the present invention, it is expected that a sole pad 20 constructed in accordance with the described preferred material characteristics will last at least one week when worn by roofing installers on a daily basis. The cost of replacement sole pads 20 is readily justified by the improved worker efficiency due to the much surer footing provided by the shoe and sole pad of the present invention.

It is preferred that the hook-and-loop fasteners used in the present invention be selected from the strongest of those type fasteners available on the market, in order to resist separation while worn by roofers working on the pitched roofs. Even when using such strong fasteners, the worker will readily be able to remove worn sole pads and quickly install replacement pads by pulling the worn sole pads from the bottom of the shoe and aligning and pressing replacement pads in place. The subsequent pressure applied by walking further anchors the sole pads to the shoes.

While the invention has been described above with reference to preferred embodiments thereof, it is to be recognized that modifications and changes to the described embodiments will become apparent to those of ordinary skill in the art, without departing from the spirit and scope of the instant invention. Accordingly, the scope of the invention is to be determined by reference to the appended claims.

What is claimed is:

1. A safety shoe for providing improved traction on sloped surfaces comprising:

a shoe having an upper portion to substantially cover the foot of a wearer and a flexible lower surface extending under a foot of a wearer;

a sacrificial sole pad constructed exclusively of a high-density, closed-cell foam material and a first fastening element comprising a layer of one of the hook portion or the loop portion of a hook and loop type fastener, said sole pad being of a size and shape to cover said flexible lower surface of said shoe, said sole pad being a substantially uniform layer of foam having a flat lower surface, said sole pad being of sufficient thickness to provide a predetermined acceptable wear life when exposed to abrasive surfaces;

a second fastening element comprising a layer of the other of the hook portion or the loop portion of a hook and loop type fastener disposed on an outer surface of said flexible lower surface of said shoe, and said first fastening element is disposed on an upper surface of said sole pad, said first and said second fastening elements being so constructed and arranged that said sole pad is capable of being removed from said shoe by pulling on said sole pad, and is capable of being refastened to said shoe by application of pressure between said shoe and said sole pad, and wherein said hook portion and said loop portion of said hook and loop type fastener are the only fastening elements employed to removably fasten said sole pad to said shoe.

2. A safety shoe as recited in claim 1 wherein said second fastening element covers substantially an entire outer surface of said lower flexible portion of said shoe.

3. A safety shoe as recited in claim 2 wherein said first fastening element covers substantially an entire upper surface of said sole pad.

4. A safety shoe as recited in claim 1 wherein said sole pad is constructed of a foam having a density in the range of about 1.5 lb/ft.$^3$ to about 30 lb/ft.$^3$.

5. A safety shoe as recited in claim 4 wherein said sole pad is constructed of a foam having a density in the range of about 4.5 lb/ft.$^3$ to about 16 lb/ft.$^3$.

6. A safety shoe as recited in claim 5 wherein said sole pad is constructed of a foam having a density in the range of about 4.5 lb/ft.$^3$ to about 8.5 lb/ft.$^3$.

7. A safety shoe as recited in claim 5 wherein said sole pad is constructed of a foam having a density in the range of about 10 lb/ft.$^3$ to about 16 lb/ft.$^3$.

8. A safety shoe as recited in claim 1 wherein said lower flexible portion has a thickness of about ⅛ inch.

9. A safety shoe as recited in claim 1 wherein said first fastening element on said sole pad is a loop-type fastener formed on a backing material, and wherein said sole pad is integrally formed on said backing material.

10. A safety sole pad for attachment to a bottom surface of footwear for providing improved traction on sloped surfaces, to aid in preventing the wearer from slipping on said sloping surface, comprising:

a flexible sole pad of a high-density, closed-cell foam material shaped such that, when attached to a footwear item, said sole pad will cover substantially an entire lower surface of said footwear item, said sole pad being of sufficient thickness to provide a predetermined acceptable wear life when exposed to abrasive surfaces;

said sole pad being constructed exclusively of a substantially uniform layer of foam having a flat lower surface, and a fastener element layer selected from the group consisting of the hook portion and the loop portion of a hook and loop type fastener, said fastener element being so constructed and arranged to be fastened to a complementary fastener element disposed on a lower flexible portion of a footwear item, and to be removable, under application of tensile forces not normally experienced in working on sloped surfaces, but not under application of lateral shearing forces, from said fastener element of said lower flexible portion substantially without damaging said fastener element of said lower flexible portion.

11. A safety sole pad as recited in claim 10 wherein said sole pad is constructed of a foam having a density in the range of about 1.5 lb/ft.$^3$ to about 30 lb/ft.$^3$.

12. A safety sole pad as recited in claim 11 wherein said sole pad is constructed of a foam having a density in the range of about 4.5 lb/ft.$^3$ to about 16 lb/ft.$^3$.

13. A safety sole pad as recited in claim 12 wherein said sole pad is constructed of a foam having a density in the range of about 4.5 lb/ft.$^3$ to about 8.5 lb/ft.$^3$.

14. A safety sole pad as recited in claim 11 wherein said sole pad is constructed of a foam having a density in the range of about 10 lb/ft.$^3$ to about 30 lb/ft.$^3$.

15. A safety sole pad as recited in claim 10 wherein the sole pad foam material comprises neoprene.

16. A safety sole pad as recited in claims 10 wherein the sole pad foam material comprises vinyl/nitrile.

17. A safety sole pad as recited in claim 10 wherein said fastener element on said sole pad is a loop-type fastener formed on a sheet backing material, and wherein said sole pad is laminated thereto when said sole pad is initially formed.

18. A safety sole pad as recited in claim 10 wherein said sole pad has a thickness in the range of about ¼ inch to about ¾ inch.

* * * * *